United States Patent [19]

Ewbank

[11] Patent Number: 4,736,685

[45] Date of Patent: Apr. 12, 1988

[54] NOISE SUPPRESSION IN TORPEDOES

[75] Inventor: Michael E. Ewbank, Rockford, Ill.

[73] Assignee: Sundstrand Corporation, Rockford, Ill.

[21] Appl. No.: 944,755

[22] Filed: Dec. 22, 1986

[51] Int. Cl.[4] ..... F42B 15/22

[52] U.S. Cl. ..... 102/399; 102/402; 416/500

[58] Field of Search ..... 102/399, 402; 416/241 A, 500

[56] References Cited

U.S. PATENT DOCUMENTS

| | | | |
|---|---|---|---|
| 3,205,822 | 9/1965 | Gustafsson et al. | 102/399 |
| 3,983,425 | 9/1976 | Barlow | 310/344 |
| 4,273,601 | 6/1981 | Weingart | 416/241 A X |
| 4,514,143 | 4/1985 | Campbell | 416/500 X |
| 4,531,362 | 7/1985 | Barry et al. | 416/500 X |
| 4,562,789 | 1/1986 | Bornhofft et al. | 102/402 X |
| 4,658,589 | 4/1987 | Sutrina | 60/646 |
| 4,671,471 | 6/1987 | Patmont | 416/241 A X |
| 4,679,980 | 7/1987 | Bland | 415/88 X |

*Primary Examiner*—Peter A. Nelson

*Attorney, Agent, or Firm*—Wood, Dalton, Phillips, Mason & Rowe

[57] ABSTRACT

Noise suppression is achieved in a closed Rankine cycle torpedo including a propulsor 36, a turbine 26 connected to the propulsor 36, the turbine 26 having an annular outlet 40. The regenerator 42 is disposed about the turbine outlet 40 and has a radially outwardly opening annular regenerator outlet 46. A hull condenser 10, 48, 52 has an axially opening inlet 54 and a conduit 56 connects the inlet 54 with the regenerator outlet 46 and has a wall 58 configured to cause fluid exiting in a radial direction from the regenerator outlet 46 to flow axially to the inlet 54. At least one curved vane 60, 62 is located within the conduit 56 for converting radial fluid flow to axial fluid flow and a sound suppressing elastomer 64, 74 is associated with each of the wall 58 and the vane 60, 62 for attenuating vibration imparted thereto by fluid impinging on the associated wall 58 or vane 60, 62.

8 Claims, 2 Drawing Sheets

NOISE SUPPRESSION IN TORPEDOES

FIELD OF THE INVENTION

This invention relates to noise suppression in torpedoes, and more specifically, to suppression of noise that would otherwise be generated by fluid flowing in a closed cycle Rankine system utilized to provide propulsion for the torpedo.

BACKGROUND OF THE INVENTION

Over the years there have been a number of proposals for turbine driven torpedoes. Initially, many of the proposals were for so-called open cycle Rankine system propulsion systems wherein a chemical reaction generated heat for vaporizing a working fluid which was employed to drive a turbine. Spent working fluid exiting the turbine was dumped overboard. While this approached adequately propelled the torpedo, it had a number of drawbacks. For one, if the working fluid did not totally condense immediately upon exiting the torpedo, or if it contained non-condensibles such as entrained air from the interior of the torpedo, it would leave a trail of bubbles allowing the torpedo to be detected.

In addition, the discharge of a gaseous fluid into water in which the torpedo was moving would likewise generate noise which could in turn result in detection of the torpedo.

Still another obstacle to the success of such proposals was due to the fact that the efficiency of the propulsion system was depth sensitive. Depending upon the depth at which the torpedo was running, the discharge of spent working fluid was against a greater or lesser head thereby raising or lowering the pressure differential across the turbine. This, needless to say, clearly affected turbine output and the running ability of the torpedo.

To avoid these and other problems, closed cycle systems were proposed. In closed cycle systems, the spent working fluid exiting the turbine was condensed in a so-called hull condenser and returned to the boiler or the like by means of a pump to be revaporized and again fed to the turbine for propulsion purposes. This approach eliminated or minimized a number of the difficulties mentioned previously that beset open cycle torpedoes. However, the development was not without a few drawbacks of its own. For example, a closed cycle system requires a so-called hull condenser in order to condense the spent working fluid. Desirably, such a system will additionally include a regenerator interposed between the turbine outlet and the hull condenser for the purpose of transferring residual heat in the spent working fluid to incoming liquid prior to its admission to the boiler to preheat the same to thereby maximize efficiency of the system.

Needless to say, the addition of a hull condenser and a regenerator as well as recycling plumbing and a pump increase the size and weight of the torpedo. This in turn has necessitated considerable expenditure of design effort to reduce the size of the various components of the system to allow a closed cycle torpedo to occupy a minimum of volume and with a minimum of weight. In order to accomplish the size reduction, however, flow paths for the working fluid are necessarily brought closer to the hull and may include abrupt changes of direction, both factors being conducive to the generation of noise within the torpedo hull, which noise may enable undesirable detection of the torpedo.

The present invention is directed to overcoming one or more of the above problems.

SUMMARY OF THE INVENTION

It is the principle object of the invention to provide a new and improved closed Rankine cycle torpedo. More specifically, it is an object of the invention to provide a means for suppressing noise that would otherwise be generated by the working fluid in a closed Rankine cycle torpedo.

According to one facet of the invention, a torpedo is provided which includes a propulsor, a turbine connected to the propulsor for driving the same, the turbine having an annular turbine outlet, and a regenerator located about the turbine outlet and having a radially outwardly opening annular regenerator outlet. A hull condenser includes an axially opening inlet and a conduit connects the inlet with the regenerator outlet. The conduit has a wall configured to cause fluid exiting the regenerator outlet in a radial direction to flow axially to the inlet. Sound suppressing means are associated with the wall for attenuating vibration imparted thereto by fluid impinging thereon.

According to another facet of the invention, there is provided a torpedo with a propulsor, a turbine, a regenerator, a hull condenser and a conduit all as mentioned previously. According to the invention, at least one curved vane is disposed within the conduit for converting radial fluid flow to axial fluid flow. Sound suppressing means are associated with the vane for attenuating vibration imparted thereto by fluid impinging thereon.

According to a highly preferred embodiment of the invention, the sound suppressing means are provided on both the vane and the conduit wall.

The invention contemplates that the sound suppressing means will comprise a layer of elastomer on each of the vane and the wall opposite of the location of fluid impingment.

In a preferred embodiment, the elastomer material is both temperature and moisture resistant allowing the use of water as a working fluid.

In a highly preferred invention, it is contemplated that the vane be hollow with the layer of elastomeric material located within the vane. The hollow vane may be made up of spaced metallic side pieces or sheets which sandwich the layer of elastomeric material, the latter being bonded to the side pieces or the sheets.

As a consequence of the various features of the invention, vibrations set up within the vanes and/or the wall as a result of converting the flow of the spent working fluid from radial to axial are attenuated rapidly before any appreciable vibration may be transmitted to the hull of the torpedo to generate noise that would enable undesirable detection of the torpedo.

Other objects and advantages will become apparent from the following specification taken in connection with the accompanying drawings.

DESCRIPTION OF THE PREFERRED EMBODIMENT

Figure 1:
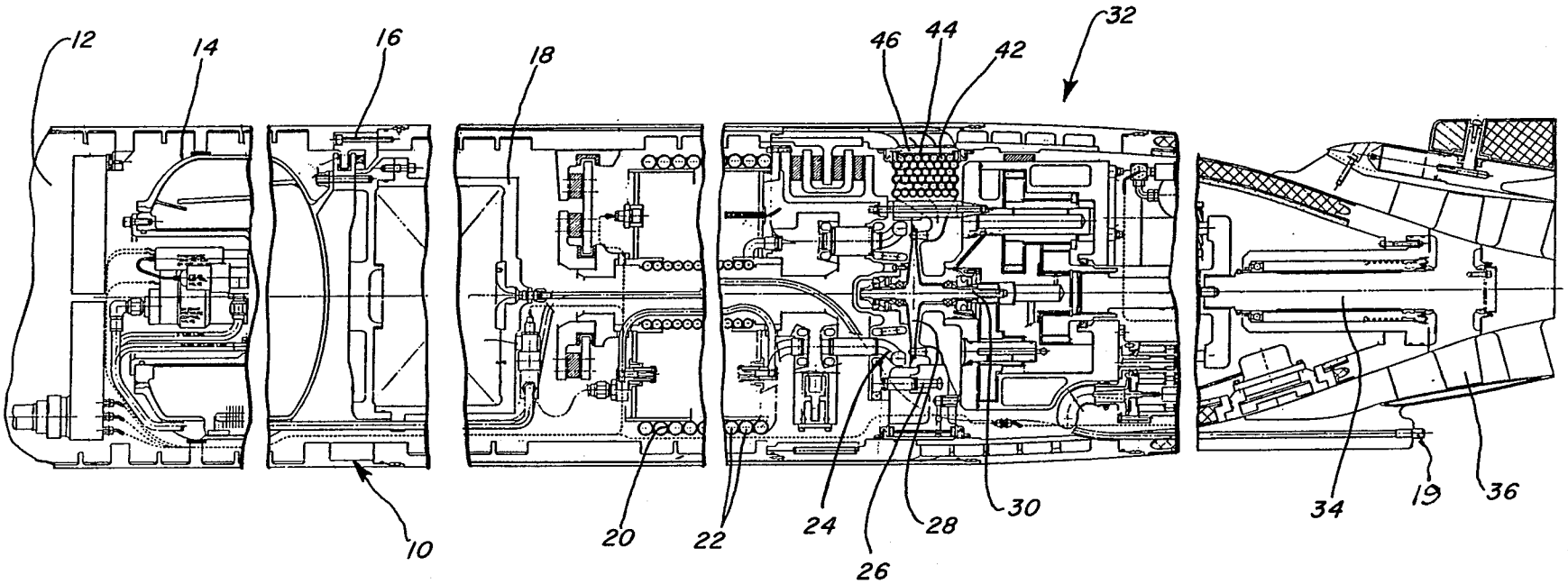
FIG. 1 is a sectional view of a torpedo made according to the invention.

An exemplary embodiment of a torpedo incorporating the invention is illustrated in FIG. 1 and with reference thereto is seen to include a hull, generally designated 10. A warhead (not shown) or the like may be attached at the forward end 12 of the hull.

Within the hull is a first tank 14 which contains an oxidant for use in a chemical reaction by which heat is generated to vaporize a working fluid to drive the torpedo by means of a closed Rankine cycle system.

A vibration suppressing mount 16 is utilized to mount the oxidant tank 14 as well as an adjacent end of a wire reel housing 18. Wire in the reel within the housing 18 may exit the torpedo via wire outlet 19. The wire is used for conventional control purposes.

Within the hull 10 is a boiler 20 which typically will contain the material to be oxidized as, for example, metallic lithium. When metallic lithium is utilized as the material to be oxidized, sulphur hexafluoride is typically contained within the tank 14.

As can be seen, the boiler 20 includes a plurality of coils 22 in which a working fluid, typically water, flows and is vaporized. By means of suitable conduits, the coils 22 are connected to the inlet manifold 24 of a turbine, generally designated 26. The turbine 26 includes a turbine wheel 28 having an output shaft 30 connected to a transmission, generally designated 32. The transmission 32 is in turn connected by any suitable means to a propulsion shaft 34 which in turn drives a propulsor 36 for the torpedo.

In the illustrated embodiment, the turbine 26 is an axial flow turbine but a turbine outlet housing 40 is utilized to direct flow radially outwardly to a heat exchanger 42 which acts as a regenerator in the closed Rankine cycle system which the torpedo employs. That is to say, the heat exchanger 42 receives spent working fluid from the turbine 26 which in turn passes radially outwardly through a plurality of coils 44. Flowing within the coils 44 is make up water to be supplied to the boiler 20. Flow is maintained by any suitable pump (not shown) through a power take-off from the turbine 26. The regenerator 42 has an annular, radially outwardly opening outlet 46 for the spent working fluid.

An elongated, relatively narrow space 48 between the hull 10 and an inner hull member 52 serves as a hull condenser. That is to say, the space 48 is in fluid communication with the outlet 46 of the regenerator to receive spent working fluid therefrom and condense the same by heat transfer through the hull 10 to the water in which the torpedo is traveling. The condensed working fluid is then collected by any suitable means and fed by the pump (not shown) through the regenerator 42 and then to the boiler 20 to be recycled.

Figure 2:
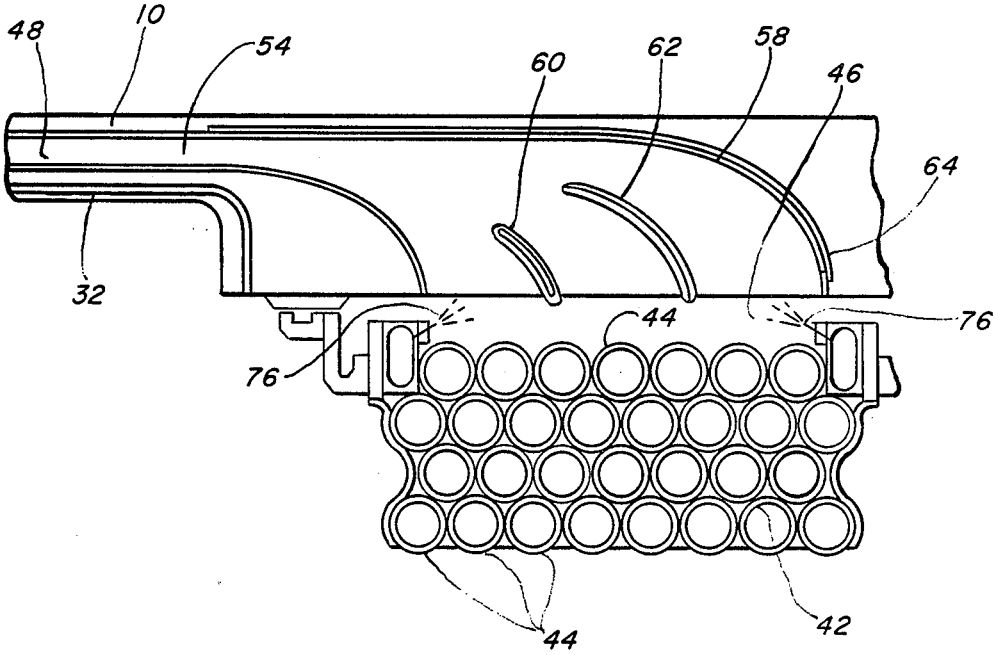
FIG. 2 is an enlarged, fragmentary, sectional view of the connection within the torpedo of a regenerator and a hull condenser.

As best seen in FIG. 2, the space 48 includes an axially opening inlet 54 which is placed in fluid communication with the radially outwardly opening outlet 46 of the regenerator 52 by means of an annular, metallic conduit, generally designated 56. The conduit 56 includes a curved outer wall 58 for the purpose of changing radial flow of the fluid emanating from the regenerator 42 to fluid flow in the axial direction toward the inlet 54 to the hull condenser.

To further assist in the transition of radial flow to axial flow, within the conduit 56 there is provided a pair of turning vanes 60 and 62. As will be appreciated, the curved wall 58 and the turning vanes 60 and 62 reduce the loss of energy in the flowing fluid stream and thereby improve efficiency of the system.

At the same time, because they affect fluid flow by changing the direction of the same, the flowing fluid will impinge against the wall 58 and vanes 60, 62 and tend to cause them to vibrate. Because of the high temperature environment and high velocities of fluid that may be involved, the wall 58 and the vanes 60 and 62 are conventionally made of metal, such as steel or aluminum; and if permitted to vibrate, could generate substantial noise that would allow detection of the torpedo.

To prevent such an occurrence, the invention contemplates the provision of sound suppressing means associated with either the wall 58 or the vanes 60 and 62, or preferably both. In a highly preferred embodiment, this is accomplished through the use of damping material. The damping material may be any suitable elastomer which is capable of resisting the high temperatures involved and not subject to degredation when exposed to moisture when the working fluid employed is water.

The elastomer, in sheet form is applied to the various components. For example, a sheet 64 of elastomer is applied to the wall 58 on its exterior side and is suitably bonded thereto by any adhesive or the like that is compatible with the elastomer selected and the metal material of which the wall 58 is formed.

Figure 3:
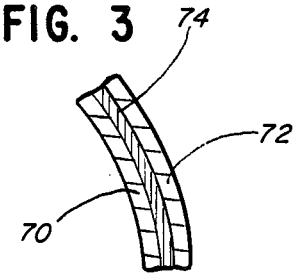
FIG. 3 is an enlarged, fragmentary, sectional view of a vane used in the torpedo.

In the case of the vanes 60 and 62, the same are made up in a sandwiched or laminated configuration with outer sheets or pieces of metal sandwiching an internal sheet of elastomeric material. Thus, FIG. 3 which represents the cross-sectional configuration of either the vanes 60 or 62 shows a first sheet 70 of metallic material and a second sheet 72 also of metallic material, sandwiching an interposed sheet 74 of elastomer.

In other words, the vanes 60 and 62 are hollow with the interior filled with the elastomeric material 74. In the preferred embodiment, the hollow is formed as mentioned previously by placing two sheets, namely the sheets 70 and 72 in closely spaced relation with corresponding parts being generally parallel to receive the sheet 74.

Desirably, water spray jets 76 are utilized at the outlet 46 to spray water in the liquid phase across the spent working fluid exiting the regenerator 46 to the conduit 56 to remove any residual super heat in the spent working fluid to assure that only saturated steam is passing out of the outlet 46.

From the foregoing, it will be appreciated that the noise suppressing means of the invention assure that undesirable vibrations that could result in undesirable early detection of the torpedo are eliminated while allowing the use of components of minimal size to minimize weight and volume of the torpedo.

I claim:

1. A closed Rankine cycle torpedo including:

a propulsor;

a turbine connected to the propulsor for driving the same and having an annular turbine outlet;

a regenerator located about said turbine outlet and having a radially outwardly opening annular regenerator outlet;

a hull condenser including an axially opening outlet;

a conduit connecting the inlet with the regenerator outlet and having a wall configured to cause fluid exiting in a radial direction from said regenerator outlet to flow axially to said inlet;

at least one curved vane within said conduit for converting radial fluid flow to axial fluid flow; and sound suppressing means associated with said wall and said vane for attenuating vibration imparted thereto by fluid impinging on the associated wall or vane.

2. The torpedo of claim 1 wherein said sound suppressing means comprises a layer of elastomer on each of said vane and said wall opposite of the location of fluid impingment.

3. The torpedo of claim 2 wherein said vane is hollow and said layer is located with said vane.

4. The torpedo of claim 3 wherein said vane is made up of spaced metallic side pieces sandwiching said layer.

5. A closed Rankine cycle torpedo including:

a propulsor;

a turbine connected to the propulsor for driving the same and having an annular turbine outlet;

a regenerator located about said turbine outlet and having a radially outwardly opening annular regenerator outlet;

a hull condenser including an axially opening outlet;

a conduit connecting the inlet with the regenerator outlet and having a wall configured to cause fluid exiting in a radial direction from said regenerator outlet to flow axially to said inlet; and sound suppressing means associated with said wall for attenuating vibration imparted thereto by fluid impinging on the wall.

6. The torpedo of claim 5 wherein said sound suppressing means comprise a layer of elastomeric material on said wall on the exterior of said conduit.

7. A closed Rankine cycle torpedo including:

a propulsor;

a turbine connected to the propulsor for driving the same and having an annular turbine outlet;

a regenerator located about said turbine outlet and having a radially outwardly opening annular regenerator outlet;

a hull condenser including an axially opening outlet;

a conduit connecting the inlet with the regenerator outlet and having a wall configured to cause fluid exiting in a radial direction from said regenerator outlet to flow axially to said inlet;

at least one curved vane within said conduit for converting radial fluid flow to axial fluid flow; and sound suppressing means associated with said vane for attenuating vibration imparted thereto by fluid impinging on the vane.

8. The torpedo of claim 7 wherein each said vane is defined by two, spaced metallic sheets with corresponding parts in generally parallel relation; and said sound suppressing means comprise a sheet of temperature and moisture resistant elastomer sandwiched between and bonded to said metallic sheets.

* * * * *